US007387006B1

(12) United States Patent
Xu et al.

(10) Patent No.: US 7,387,006 B1
(45) Date of Patent: Jun. 17, 2008

(54) SENSING SYSTEM FOR SHEET METAL FORMING TOOL

(75) Inventors: Diane Xu, Northville, MI (US); Joseph Genereux, Westland, MI (US); Gary Smith, Shelbyville, KY (US)

(73) Assignee: Ford Motor Company, Dearborn, MI (US)

( * ) Notice: Subject to any disclaimer, the term of this patent is extended or adjusted under 35 U.S.C. 154(b) by 43 days.

(21) Appl. No.: 11/609,603

(22) Filed: Dec. 12, 2006

(51) Int. Cl.
*B21D 22/22* (2006.01)

(52) U.S. Cl. ..... 72/17.1; 72/347; 72/350

(58) Field of Classification Search ..... 72/17.3, 72/18.2, 19.4, 347, 350, 351; 324/207.18, 324/207.19; 336/200; 29/847; 700/146
See application file for complete search history.

(56) References Cited

U.S. PATENT DOCUMENTS 4,259,052 A 3/1981 Imanishi et al.
4,483,173 A 11/1984 Duhamel
4,878,368 A * 11/1989 Toutant et al. ..... 72/8.3
5,138,857 A 8/1992 Siegert
5,148,697 A 9/1992 Shiraishi et al.
5,319,951 A * 6/1994 Da Re ..... 72/16.3
5,544,945 A 8/1996 Daudi
5,950,479 A 9/1999 Kutschker
5,970,766 A 10/1999 Sosa-Razon et al.
6,769,280 B2 8/2004 Cao et al.
7,130,708 B2 * 10/2006 Wang et al. ..... 700/111
7,257,460 B2 * 8/2007 Venugopal et al. ..... 72/351

* cited by examiner

*Primary Examiner*—David B Jones
(74) *Attorney, Agent, or Firm*—Raymond Coppiellie; Brooks Kushman P.C.

(57) ABSTRACT

A sensing system for sensing the presence of a blank or part in the sheet metal forming tool. A blank holder assembly has a fixed bracket that is fixed to a lower die of the tool and a movable bracket that is moved with the upper die of the tool. A proximity sensor is attached to the movable bracket and senses the presence or absence of an edge of a blank or part during the course of a sheet metal forming operation.

17 Claims, 3 Drawing Sheets

SENSING SYSTEM FOR SHEET METAL FORMING TOOL

BACKGROUND OF THE INVENTION

1. Field of the Invention

The present invention relates to a blank or part sensing system for sheet metal forming tools that permits sensing the presence of a blank or part during a forming process.

2. Background Art

Metal parts may be formed in sheet metal forming process in which a blank is formed in a series of steps into a finished part. Several presses may be arranged and aligned to sequently form a part. Parts may be initially drawn in a draw die, and then may be spanked, trimmed, and punched in subsequent press forming operations. The sheet metal parts may also be made in a transfer press in which a die having multiple stations is operated by a single press that has a die with multiple stations that perform prescribed steps in sequence to form a finished part.

Sensors are used in sheet metal forming processes to control the operation of one or more presses. Sensors may be provided in the dies and also may be provided on loaders, shuttles, conveyors and other material handling equipment that is used to load blanks or partially formed parts. Different types of sensors may be used in sheet metal forming processes include limit switches, reed switches, Hall Effect switches, or proximity sensors.

One application for a sensor used in a sheet metal forming tool is as a blank or part presence detector. A part presence detector is used to detect whether a sheet metal blank or a partially formed part is in the proper position for performing the next operation. If a part presence detector provides a false indication that a part is in the desired position the part, die, or tool may be damaged if, in fact, the part is out of location. If a part is mishit by a sheet metal forming tool the part may be scrapped and the tool may be damaged. If a part presence detector indicates the presence of a panel when no panel is in the tool, the tool may be damaged. If a sheet metal forming tool is cycled without performing the desired the operation on the part, the number of parts produced may be inaccurately reflected.

Variations in the strength or resiliency of a blank or part may result in unexpected spring back in the part after a forming operation. Bowed blanks or parts may be difficult to sense by a part presence detector since the blank may be bowed in an area where the sensor is oriented to detect the presence of the blank.

High speed production lines have short cycle times that afford less time for a blank or part to nest within the tool. Less time is also available for sensing that the part is properly nested in the tool. Some part shapes present challenges for locating sensors that accurately and quickly sense the location of a blank or part.

In some instances, it would be advantageous to provide a part presence detector that senses the presence of a part throughout a forming process even as the edge of a part moves during the drawing or forming cycle.

There is a need for an accurate system for sensing the presence of a blank or part. There is a further need for a part sensing system that provides a quick response and is capable of providing an accurate indication of the presence of a part throughout a forming cycle. By providing an improved part presence detecting system a reduction in false signals from the part sensing system can result in reduced downtime and scrap.

The above problems and needs are addressed by applicant's invention as summarized below.

SUMMARY OF THE INVENTION

A sensing system for a sheet forming tool is provided that senses the edge of a blank or part on a blank holder throughout a forming cycle. The sheet metal forming tool is loaded with a blank or other part and has an upper die that is moved reciprocally relative to a lower die in a drawing cycle. The sensing system comprises a blank holder assembly that has a support member on which the blank nests when loaded. A proximity sensor is attached to the blank holder assembly adjacent to the support member. A fluid cylinder having an extensible rod supports the blank holder and proximity sensor. The rod is moved by the cylinder between a raised position and a lowered position. The fluid cylinder biases the rod toward the raised position. The upper die operatively applies an opposing force to the bias of the cylinder to cause the blank holder and proximity sensor to be moved to the lowered position. The proximity sensor senses that an edge of the blank is located on the blank holder throughout the course of the press cycle.

Other aspects of the sensing system may comprise that the blank holder and proximity sensor are moved away from the die during the forming cycle by the upper die. The support member may have a blank supporting surface that supports the blank about its periphery. The blank holder has at least one blank loading guide that guides the blank into the blank holder.

In addition, the blank holder may have a fixed bracket that is fixed relative to the lower die and a movable bracket that supports the support member and the proximity sensor for movement in response to movement of the upper die. A controller controls the operation of the tool in response to the proximity sensor sensing the presence of the blank. The sensor generates a signal that is provided to the controller and is processed to permit operation of the tool.

In another embodiment, a sensor assembly is provided for a forming tool that is used to form a sheet metal part. The sensor assembly comprises a fluid cylinder having an extensible rod that is moved between the retracted position and an extended position. A part holder assembly has a fixed bracket that is fixed relative to a lower portion of the tool and a movable bracket that is attached to the extensible rod of the fluid cylinder and includes a part supporting member. The sensor is attached to the movable bracket of the part holder and is located adjacent to the part supporting member. The upper portion of the tool reciprocates relative to the lower portion of the tool. The cylinder urges the extensible rod to the extended position which raises the movable bracket including the part supporting member and sensor until the upper portion of the tool engages the movable bracket. The bracket and extensible rod are moved against the force of the cylinder toward the retracted position when the upper portion of the tool engages the movable bracket.

According to other aspects of the above sensor assembly, the movable bracket, sensor and rod return to their raised positions as the upper portion of the tool moves away from the lower portion of the tool during a forming cycle. The blank supporting member has a blank supporting surface that supports the blank about a portion of the periphery of the blank. The blank holder assembly has at least one blank loading guide that guides the blank to the blank supporting member. A controller controls the operation of the metal forming tool based in part upon the output of the sensor that senses the presence of the part. The sensor generates a signal that is provided to the controller and processed in the course of continued operation of the forming tool.

A method is also provided for sensing the position of a sheet metal part during a forming cycle of a press. The press has an upper portion that moves reciprocally relative to a lower portion of the press. A tool is attached to the press that has a part holder assembly including a fixed bracket that is fixed relative to the lower portion of the press and a movable bracket that is attached to an extensible rod of a fluid cylinder. A part supporting member and a sensor that is disposed adjacent to the part supporting member is attached to the movable bracket. The method starts with loading a part into the part holder assembly. The presence of the part in the part holder assembly is initially sensed by the sensor. The upper portion of the press is lowered to form a part and also drives the movable bracket against a biasing force applied by the fluid cylinder. The position of the part is continuously sensed by the sensor during the forming cycle of the press. The movable bracket of the part holder assembly that is attached to the extensible rod of the fluid cylinder is returned to a part loading position as the upper portion of the press is raised.

According to other aspects of the method, during the step of raising the upper portion of the press, the movable bracket of the part holder assembly may be placed in contact with and follow the upper portion of the press until an upper limit of movement of the movable bracket is reached. The upper portion of the press continues to move after the upper limit of movement of the movable bracket is reached to provide clearance for loading and unloading parts. The sensor may generate a signal indicative of the presence of a part that is sent to a controller. The controller only permits operation of the press if the signal is received by the controller during designated periods of the forming cycle. A second tool may be provided with a second part holder assembly to which the part is transferred for subsequent forming operations. The steps of the method may be repeated with the second tool. The sensor may sense the edge of the part as the edge of the part moves toward the forming cavity.

These and other aspects and optional features will be better understood in view of the attached drawings and the following detailed description of the illustrated embodiments.

DETAILED DESCRIPTION OF THE PREFERRED EMBODIMENT(S)

Figure 1:
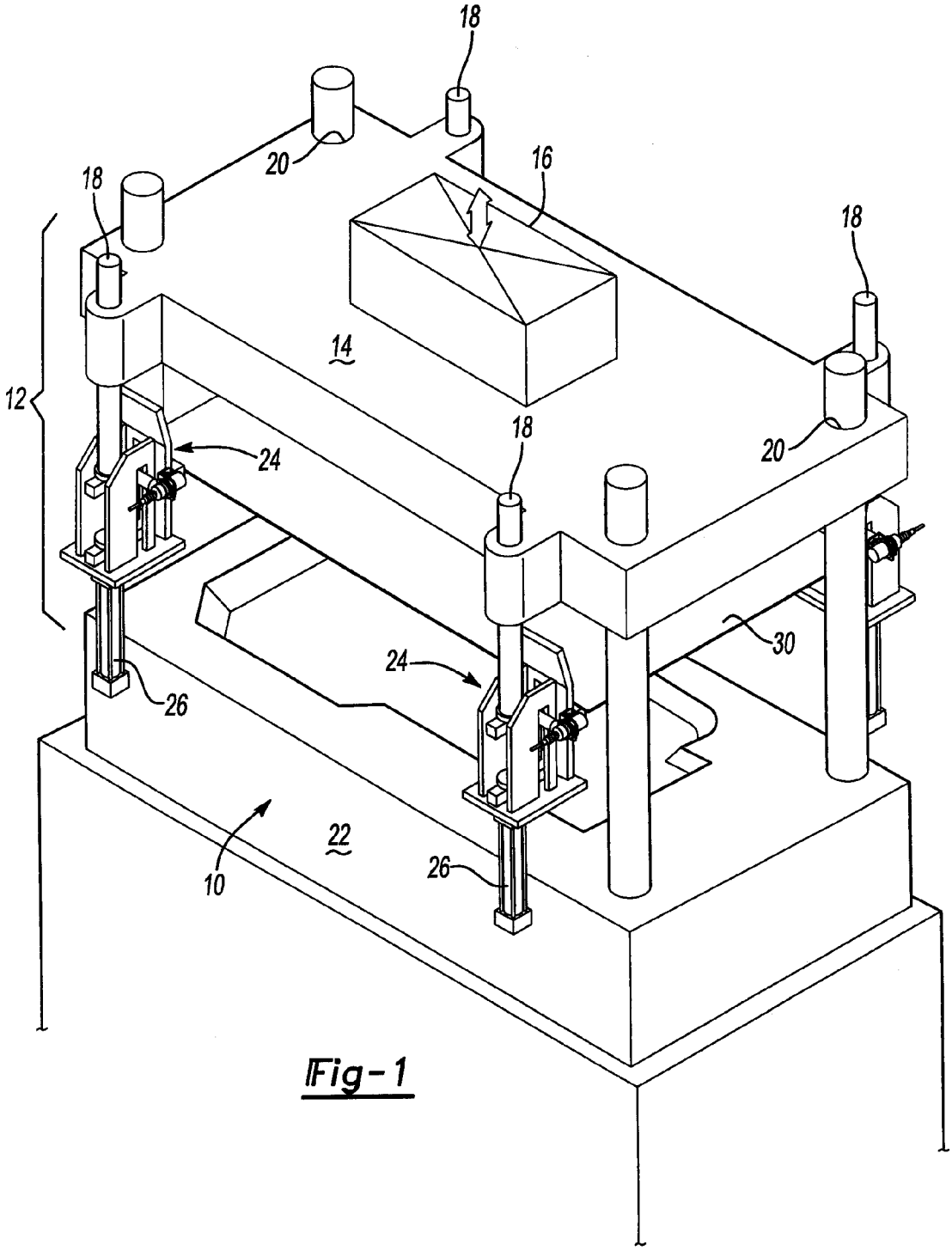
FIG. 1 is a perspective view of a sheet metal forming tool equipped with four blank holder assemblies.

Referring to FIG. 1, a sensing system 10 of the present invention is shown in conjunction with a sheet metal forming tool 12. The sheet metal forming tool 12 includes an upper die 14 that is disposed around a ram 16. Die pins 18 are provided in die pin pockets 20 defined by the upper die 14. A lower die 22 is used to form a part as will be more fully described below.

The sensing system 10 includes a blank holder assembly that is generally indicated by reference numeral 24. The blank holder assembly 24 is connected to a fluid cylinder 26.

Figure 2:
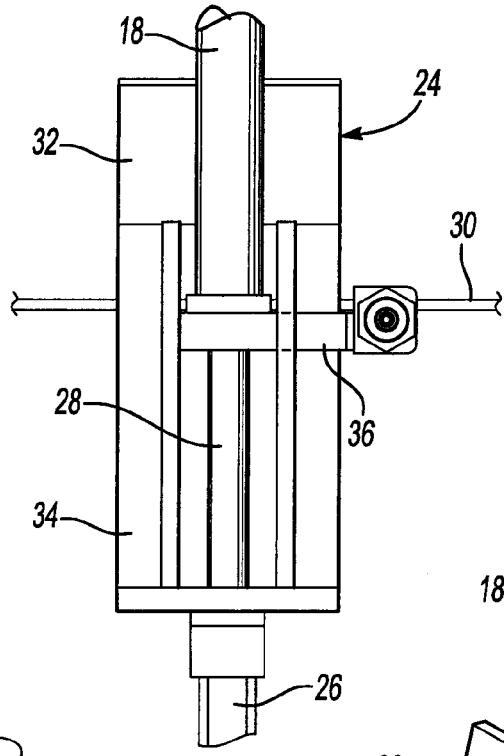
FIG. 2 is a side elevation view of a blank holder assembly.

Referring to FIG. 2, the blank holder assembly 24 is shown in greater detail. The fluid cylinder 26 has an extensible rod 28 that is movable between a raised position and a lowered position. A blank 30 is supported by the blank holder assembly 24 with the extensible rod 28 in the raised position. Blank loading guides 32 are formed as part of a fixed bracket 34. The fixed bracket 34 is secured to the lower die 22 (shown in FIG. 1). A movable bracket 36 forms part of the blank holder assembly 24. The movable bracket 36 is moved by the action of the extensible rod 28 and the die pins 18. The extensible rod 28 normally urges the movable bracket 36 toward the raised position. However, the biasing force applied by the extensible rod 28 is overcome and the rod 28 is driven back to its lowered position during the press cycle when the upper die 14 (shown in FIG. 1) reciprocates downwardly. The movable bracket 36 is secured to the extensible rod 28 and moves upwardly and downwardly with the rod 28 and die pin 18.

Figure 3:
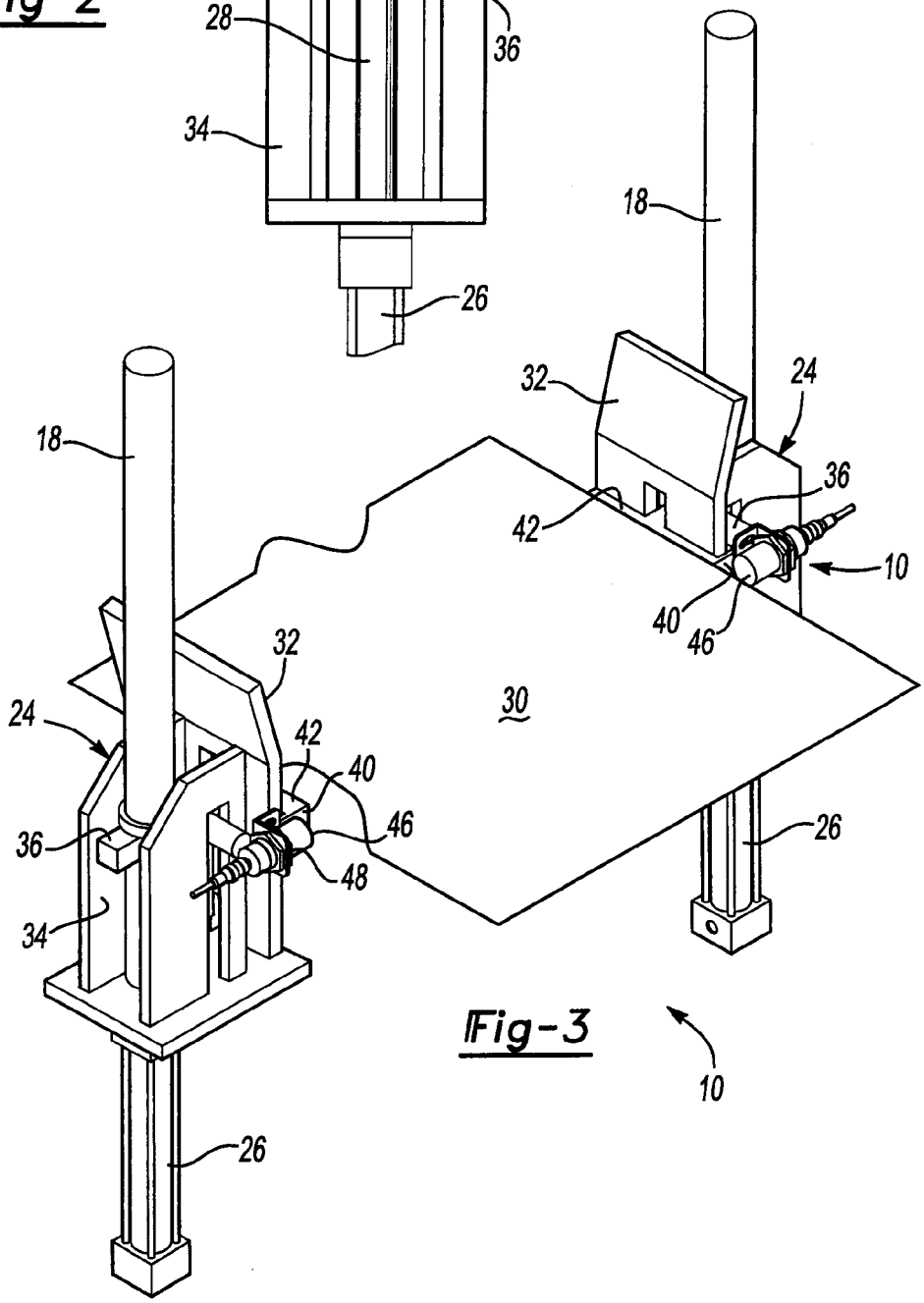
FIG. 3 is a perspective view of two blank holder assemblies supporting a blank.

Referring to FIG. 3, two blank holder assemblies 24 are shown supporting a blank 30 separate and apart from a sheet metal forming tool 12. The blank holder assembly 24 has a support member 40 that forms part of the movable bracket 36 but is used to support the blank 30 on a support surface 42. A proximity sensor 46 is secured to the movable bracket 36 adjacent to the supporting surface 42. Other types of sensors may be used if desired and should be understood to be equivalents of a proximity sensor. The proximity sensor 46 is attached to the movable bracket 36 by a sensor clip 48. The blank holder assembly 24 is normally urged towards its raised position as shown in FIG. 3 by the fluid cylinder 26. The biasing force applied by the cylinder 26 is opposed by displacement of the die pins 18 on the down stroke of the upper die 14 when the upper die 14 is driven towards the lower die 22 (shown in FIG. 1).

Figure 4:
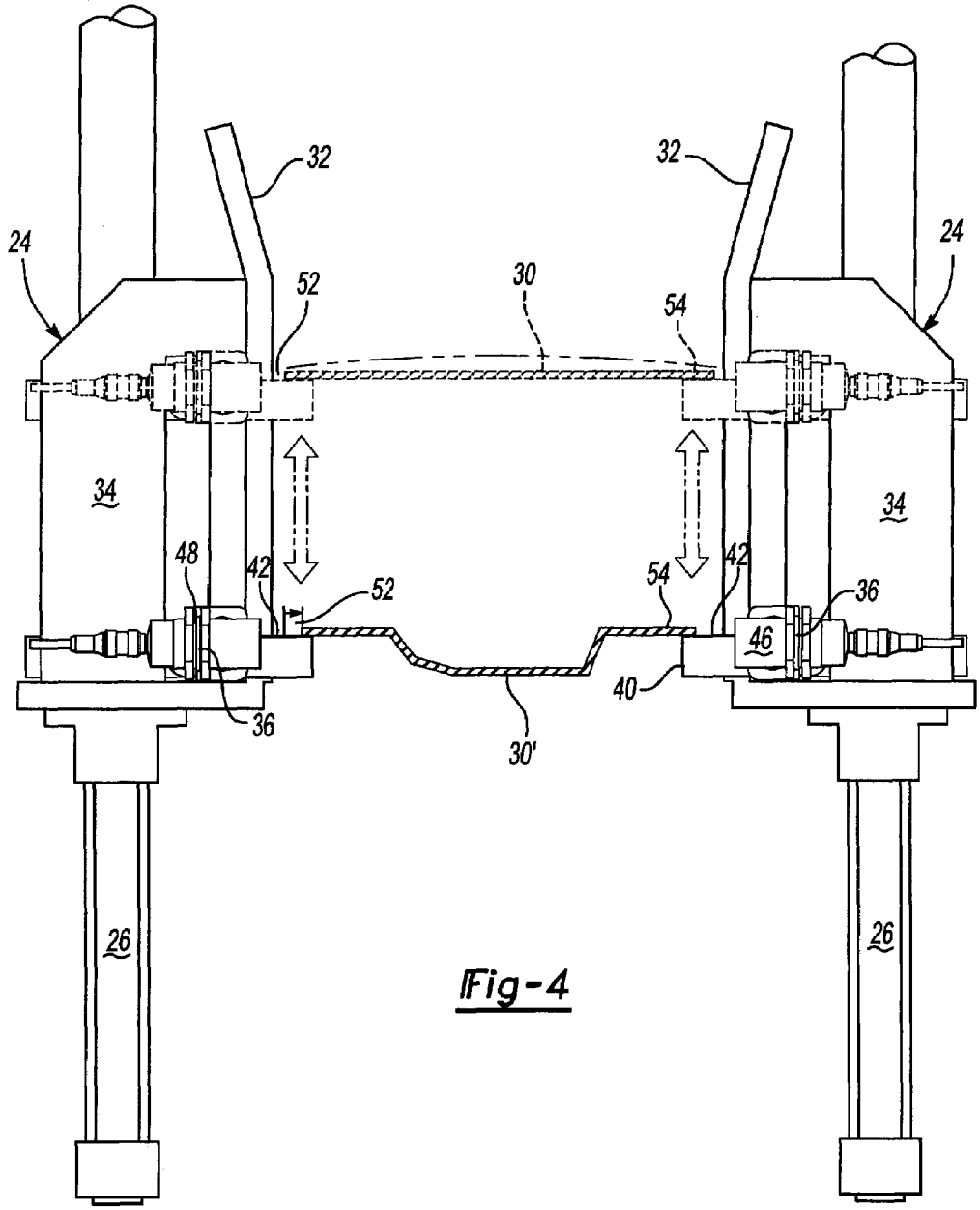
FIG. 4 is an end elevation view showing two blank holder assemblies supporting a formed part in a lower position and a blank in a raised position in phantom.

Referring to FIG. 4, two blank holder assemblies 24 are shown supporting a blank 30 in the upper position in an unformed condition. A formed part 30' is shown in phantom lines with the blank holder assemblies 24 in their lower position in solid lines. Blank 30 is initially loaded into the blank holder assembly 24 and is guided in place by the blank holding guides 32. The blank 30 is received on the supporting surface 42 of the support member 40. The proximity sensors 46 are located adjacent to the support member 40 and are oriented to sense an edge 52 of the blank 30. The blank has a peripheral portion 54 just inboard of the edge 52. The peripheral portion 54 of the blank 30 is supported on the support member 42.

After the blank 30 has nested in the blank holder assembly 24, as shown in phantom in FIG. 4, the press is ready to cycle. The upper die 14 and ram 16 are moved by the press initially towards the lower die 22 on a downstroke and then away from the lower die 22 on the upward return stroke of the press. The blank 30 is formed into a part 30' during the downward movement of the binder 14 and ram 16. As the blank 30 is formed into the part 30' the forming operation may draw the edge 52 of the blank 30 toward the center of the sheet metal forming tool 12. The peripheral portion 54 of the part 30' remains supported by the support member 40 but to a lesser extent then the peripheral portion 54 supports the unformed blank 30.

The movable bracket 36 including the proximity sensor 46 and support member 40 move reciprocally as shown by the double headed phantom arrows in FIG. 4. The relative positions of the proximity sensor 46, support member 40, and the edge 52 of the blank 30 are maintained throughout the forming cycle of the press. The relative positions are maintained even though the movable bracket 36 of the blank holder assembly 24 first moves downwardly and then upwardly during the forming operation.

The proximity sensors 46 should be calibrated to sense the edge 52 of the blank 30 and formed part 30' throughout the forming cycle even if the edge of the blank 30 moves away from the proximity sensor 46. The die pins 18 drive the movable bracket 36 downwardly against the force applied by the fluid cylinders 26 on the downstroke of the press. The fluid cylinders 26 urge the movable bracket 36 upwardly on the up stroke as limited by the upward movement of the die pins 18.

While the best mode for carrying out the invention has been described in detail, those familiar with the art to which this invention relates will recognize various alternative designs and embodiments for practicing the invention as defined by the following claims.

What is claimed is:

1. A sensing system for a sheet metal forming tool that is loaded with a blank, the sheet metal forming tool has an upper die that is reciprocally moved relative to a lower die in a drawing cycle, the sensing system comprising:

a blank holder assembly onto which the blank is loaded, the blank holder assembly has a support member on which the blank nests when loaded into a design position on the blank holder assembly;

a proximity sensor is attached to the blank holder assembly in a location adjacent to the support member;

a fluid cylinder having an extensible rod supports the blank holder and proximity sensor, the rod is moved by the cylinder between a raised position and a lowered position, wherein the fluid cylinder biases the rod toward the upper position and the upper die operatively applies an opposing force to the bias of the cylinder and causes the blank holder and proximity sensor to be moved to the lowered position; and wherein the proximity sensor senses that an edge of the blank is located on the blank holder throughout the drawing cycle.

2. The sensing system of claim 1 wherein the blank holder, proximity sensor and rod return to the raised position as the upper die is moved away from the lower die during the drawing cycle.

3. The sensing system of claim 1 wherein the blank holder has a blank supporting surface that supports the blank about the periphery of the blank.

4. The sensing system of claim 1 wherein the blank holder has at least one blank loading guide that guides the blank into the blank holder.

5. The sensing system of claim 1 wherein the blank holder has a fixed bracket that is fixed relative to the lower die and a movable bracket that supports the blank supporting surface and the proximity sensor for movement in response to movement of the upper die.

6. The sensing system of claim 1 further comprising a controller that controls operation of the metal forming tool, wherein the proximity sensor senses the presence of the blank and generates a signal that is provided to the controller and interpreted to permit operation of the metal forming tool.

7. A sensor assembly for a forming tool that is utilized to form a sheet metal part, the forming tool having an upper portion and a lower portion, the sensor assembly comprising:

a fluid cylinder has an extensible rod that is moved between a retracted position and an extended position;

a part holder assembly having a fixed bracket that is fixed relative to the lower portion of the tool and a movable bracket that is attached to the extensible rod of the fluid cylinder and includes a part supporting member;

a sensor attached to the movable bracket of the part holder, wherein the sensor is disposed adjacent to the part supporting member; and wherein the upper portion of the tool reciprocates relative to the lower portion of the tool and wherein the cylinder urges the extensible rod to the extended position which raises the movable bracket including the part supporting member and the sensor until the upper portion of the tool operatively engages the movable bracket against the force of the cylinder to move the movable bracket and extensible rod toward the retracted position.

8. The sensor assembly of claim 7 wherein the movable bracket, sensor and rod return to the raised position as the upper portion of the tool is moved away from the lower portion of the tool during the drawing cycle.

9. The sensor assembly of claim 7 wherein the part supporting member has a part supporting surface that supports the part about the periphery of the part.

10. The sensor assembly of claim 7 wherein the part holder assembly has at least one part loading guide that guides the part to the part supporting member.

11. The sensor assembly of claim 7 further comprising a controller that controls operation of the metal forming tool, wherein the sensor senses the presence of the part and generates a signal that is provided to the controller and interpreted to permit operation of the forming tool.

12. A method of sensing the position of a sheet metal part during a forming cycle of a press, the press having an upper portion that is moved reciprocally relative to a lower portion of the press, a tool attached to the press that has a part holder assembly that includes a fixed bracket that is fixed relative to a lower portion of the press and a movable bracket that is attached to an extensible rod of a fluid cylinder and includes a part supporting member, a sensor attached to the movable bracket of the part holder assembly, wherein the sensor is disposed adjacent to the part supporting member, the method comprising:

loading the part into the part holder assembly;

sensing the initial presence of the part in the part holder assembly with the sensor;

lowering the upper portion of the press to form a part and to operatively engage the movable bracket and drive the movable bracket against a biasing force applied by the fluid cylinder to the movable bracket;

continuing sensing the position of the part with the sensor during the forming cycle of the press;

raising the upper portion of the press; and returning the movable bracket of the part holder assembly on the extensible rod of the fluid cylinder to a part loading position.

13. The method of claim 12 wherein during the step of raising the upper portion of the press, the movable bracket of the part holder assembly is in contact with and follows the upper portion of the press until an upper limit of movement of the movable bracket is reached.

14. The method of claim 13 wherein during the step of raising the upper portion of the press, the upper portion of the press continues moving after the upper limit of movement of the movable bracket is reached to provide clearance for loading the part.

15. The method of claim 12 further comprising generating a signal indicative of the presence of the part by the sensor that is sent to a controller that only permits operation of the press if the signal is received by the controller during designated periods of the forming cycle.

16. The method of claim 12 further comprising transferring the part to a subsequent operation in a second tool that is provided with a second part holder assembly and repeating the steps of the method with the second tool.

17. The method of claim 12 wherein a peripheral portion of the part has an edge that is sensed by the sensor and wherein the edge is drawn toward a forming cavity of the tool as the part is formed, and wherein the sensor is calibrated to sense the edge throughout the range of movement of the edge toward the forming cavity.

* * * * *